US011771129B2

(12) United States Patent
Liu et al.

(10) Patent No.: US 11,771,129 B2
(45) Date of Patent: Oct. 3, 2023

(54) COMPACT CIGARETTE MANUFACTURING MACHINE

(71) Applicant: Jiandong Liu, Zhejiang (CN)

(72) Inventors: Jiandong Liu, Zhejiang (CN); Guosheng Song, Zhejiang (CN)

(73) Assignee: Jiandong Liu, Ruian (CN)

( * ) Notice: Subject to any disclaimer, the term of this patent is extended or adjusted under 35 U.S.C. 154(b) by 96 days.

(21) Appl. No.: 17/319,680

(22) Filed: May 13, 2021

(65) Prior Publication Data

US 2022/0160019 A1 May 26, 2022

(30) Foreign Application Priority Data

Nov. 25, 2020 (CN) ..... 202011342877.0

(51) Int. Cl.

| | |
|---|---|
| ***A24C 5/02*** | (2006.01) |
| ***A24C 5/06*** | (2006.01) |
| ***A24C 5/39*** | (2006.01) |

(52) U.S. Cl.

CPC ..... *A24C 5/06* (2013.01); *A24C 5/02* (2013.01); *A24C 5/395* (2013.01); *A24C 5/398* (2013.01); *A24C 5/399* (2013.01)

(58) Field of Classification Search

CPC .... A24C 5/06; A24C 5/40; A24C 5/42; A24C 5/395; A24C 5/398; A24C 5/399

See application file for complete search history.

(56) References Cited

U.S. PATENT DOCUMENTS

| | | | | |
|---|---|---|---|---|
| 1,859,965 A * | 5/1932 | Gwinn | ..... | A24C 5/395 131/109.3 |
| 2,551,095 A | 5/1951 | Chaze | | |
| D250,965 S | 1/1979 | Moscovitch | | |
| 4,620,551 A | 11/1986 | Ruppert | | |
| 5,088,506 A | 2/1992 | Kastner | | |

(Continued)

FOREIGN PATENT DOCUMENTS

CN 201138314 Y 10/2008

OTHER PUBLICATIONS

Search Report from European Application No. 21192575.5 dated Feb. 11, 2022.

(Continued)

*Primary Examiner* — Michael J Felton
*Assistant Examiner* — Ronnie Kirby Jordan
(74) *Attorney, Agent, or Firm* — Calfee, Halter & Griswold LLP

(57) ABSTRACT

A compact cigarette manufacturing machine comprises a housing, a filling pipe, a loading element, a presser, and a push spoon. The housing encloses a material chamber comprising a bottom surface and an open end for receiving materials. The filling pipe is disposed on the housing to define a filling tip, and extends into a filling cavity in communication with the material chamber. The loading element is assembled with the housing and is operable to load the materials into the filling cavity through an opening of the bottom surface of the material chamber. The presser is assembled with the housing and is operable to press the materials loaded in the filling cavity. A push spoon slidably disposed inside the filling cavity is operable to deliver the materials in the filling cavity into a cigarette tube loaded on the filling tip.

18 Claims, 13 Drawing Sheets

(56) References Cited

U.S. PATENT DOCUMENTS

| | | | |
|---|---|---|---|
| D522,691 | S | 6/2006 | Willis |
| D570,540 | S | 6/2008 | Feldmann et al. |
| D613,033 | S | 4/2010 | Lin |
| 7,905,235 | B2 | 3/2011 | Patel |
| D659,901 | S | 5/2012 | Lin |
| 8,171,939 | B2 | 5/2012 | Bao |
| D665,126 | S | 8/2012 | Lin |
| 8,261,752 | B2 | 9/2012 | Bao |
| 8,387,622 | B1 | 3/2013 | Moscovitch |
| D692,616 | S | 10/2013 | Patel |
| D700,399 | S | 2/2014 | Lin |
| D718,462 | S | 11/2014 | Cook et al. |
| 9,380,808 | B2 | 7/2016 | Bao |
| D769,521 | S | 10/2016 | Lin |
| 9,661,877 | B2 | 5/2017 | Bao |
| 9,949,503 | B2 | 4/2018 | Lin et al. |
| D881,464 | S | 4/2020 | Lin |
| 2004/0255962 | A1 | 12/2004 | Moser et al. |
| 2006/0096604 | A1 | 5/2006 | Moser et al. |
| 2010/0229880 | A1 | 9/2010 | Bao |
| 2011/0056504 | A1 | 3/2011 | Laplante |
| 2013/0047996 | A1* | 2/2013 | Ryszard et al. ..... A24C 5/06 131/70 |
| 2013/0276795 | A1 | 10/2013 | Tang |
| 2014/0202471 | A1 | 7/2014 | Bao |
| 2016/0374389 | A1 | 12/2016 | Bao et al. |
| 2019/0150499 | A1 | 5/2019 | Bao et al. |
| 2020/0281251 | A1 | 9/2020 | Liu |

OTHER PUBLICATIONS

Brown, Five Hundred and Seven Mechanical Movements, 42-43, 1995.

Cigarette Manufacturing Machine by: TOP Machine Top O Matic T2 Makes 100's and Kings found online (Mar. 1, 2012) https://www.tobaccogeneral.com/top-machine-top-o-matic-2792-prd1.htm (Mar. 1, 2012).

* cited by examiner

COMPACT CIGARETTE MANUFACTURING MACHINE

CROSS-REFERENCE TO RELATED APPLICATION

The present application claims benefits and priority to Chinese Patent Application No. 202011342877.0, filed on Nov. 25, 2020, the entire disclosure of which is incorporated herein by reference.

TECHNICAL FIELD

The present application is directed to devices used in manufacturing cigarettes from cut tobacco or other materials, and more particularly to compact cigarette manufacturing machines suitable for domestic use.

BACKGROUND

Cigarettes are made by roasting and cutting tobacco leaves, and rolling the cut tobacco in a sheet of paper into a cylindrical shape with about 100 mm of length and about 8 mm of diameter. Cigarettes are consumed by lighting one end, and inhaling the smoke at the other end. Processes for making cigarette may include roasting and steaming cured tobacco leaves (at various temperatures and for various durations, for different flavors), removing debris and shredding the tobacco leaves in a machine to transform large tobacco leaves into smaller compressed tobacco leaves, cutting the tobacco leaves into cut tobacco, and packing the cut tobacco with filter and cutting into segments.

The cigarette manufacturing machines currently in use are large in size and require a large amount of cut tobacco for each use, resulting in waste in small-scale operations. Therefore, there is a need for a cigarette manufacturing machine suitable for small-scale, domestic use.

SUMMARY

According to an exemplary aspect of the present disclosure, a compact cigarette manufacturing machine comprises a housing, a filling pipe, a loading element, a presser, and a push spoon. The housing encloses a material chamber having a bottom surface and an open end for receiving cut tobacco. The filling pipe defines a filling tip, and extends into a filling cavity in communication with the material chamber through an opening of the bottom surface of the material chamber. The loading element is assembled with the housing and is operable to load the cut tobacco into the filling cavity through the opening of the bottom surface of the material chamber. The presser is assembled with the housing and is operable to press the cut tobacco loaded in the filling cavity. The push spoon is slidably disposed inside the filling cavity and is operable to deliver the materials in the filling cavity into a cigarette tube loaded on the filling tip of the filling pipe.

Further features and advantages of the invention will become apparent from the following detailed description made with reference to the accompanying drawings.

DETAILED DESCRIPTION

Figure 1A:
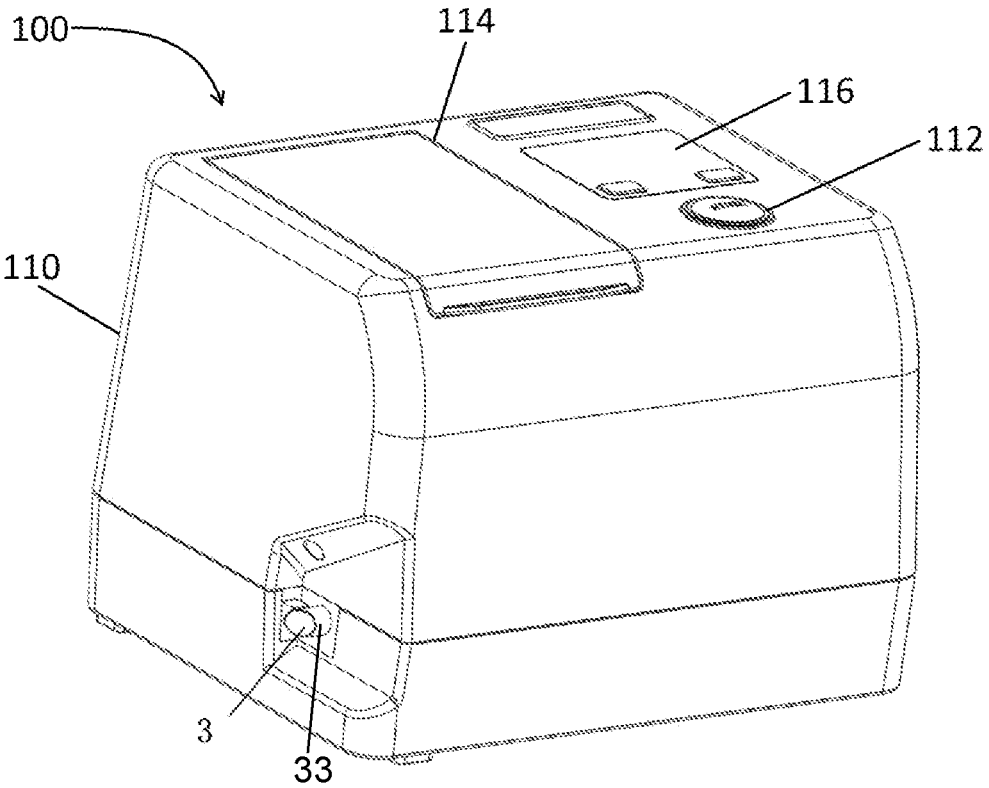
FIG. 1A is a front-top-left side perspective view of a compact cigarette manufacturing machine according to an exemplary embodiment.
Figure 1B:
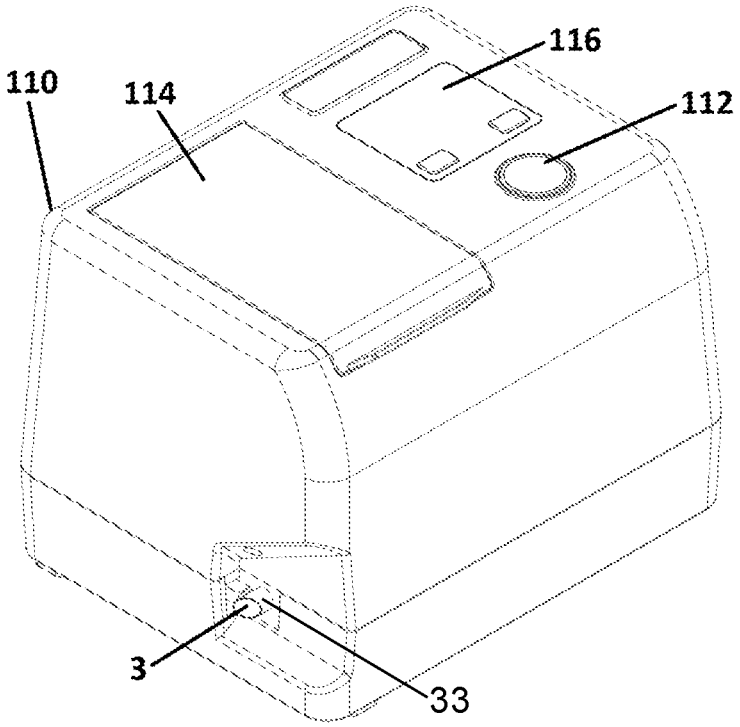
FIG. 1B is another front-top-left side perspective view of the compact cigarette manufacturing machine shown in FIG. 1A.
Figure 1C:
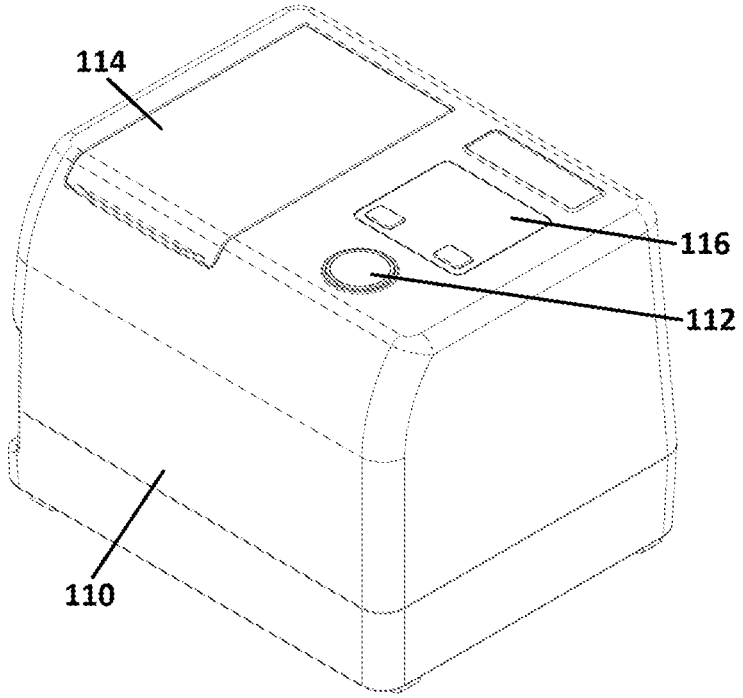
FIG. 1C is a front-top-right side perspective view of the compact cigarette manufacturing machine shown in FIGS. 1A-1B.
Figure 1D:
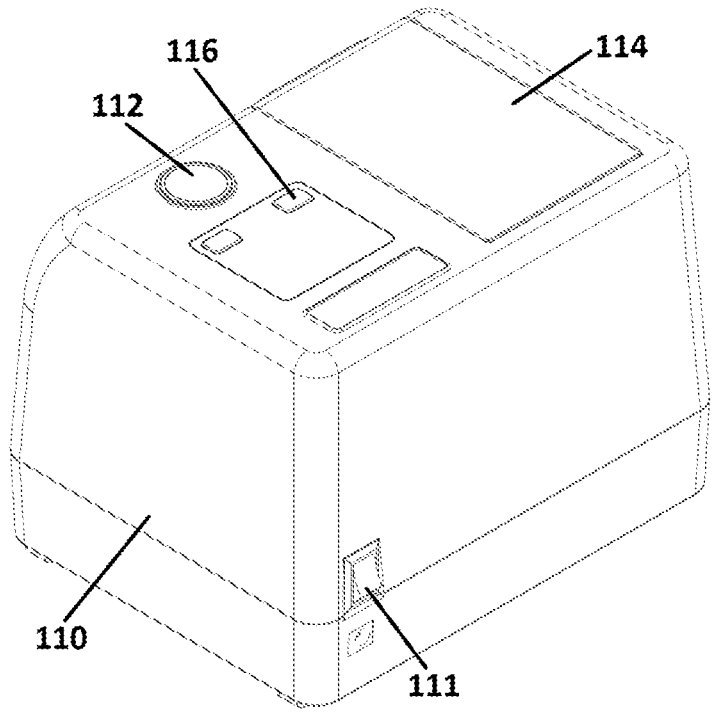
FIG. 1D is a rear-top-right side perspective view of the compact cigarette manufacturing machine shown in FIGS. 1A-1C.
Figure 1E:
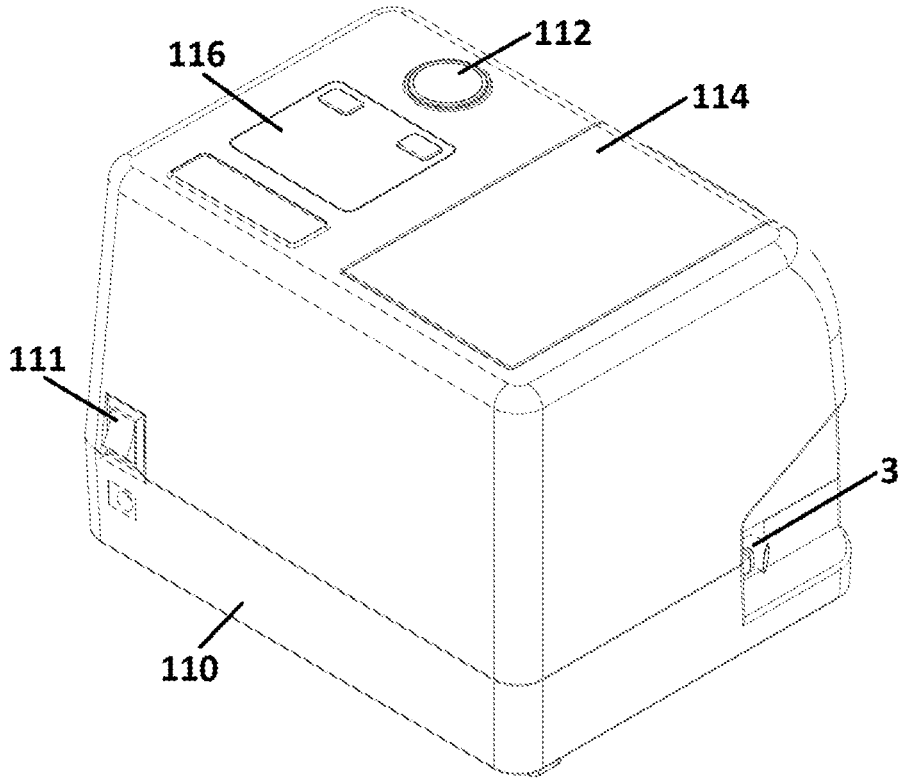
FIG. 1E is a rear-top-left side perspective view of the compact cigarette manufacturing machine shown in FIGS. 1A-1D.
Figure 1F:
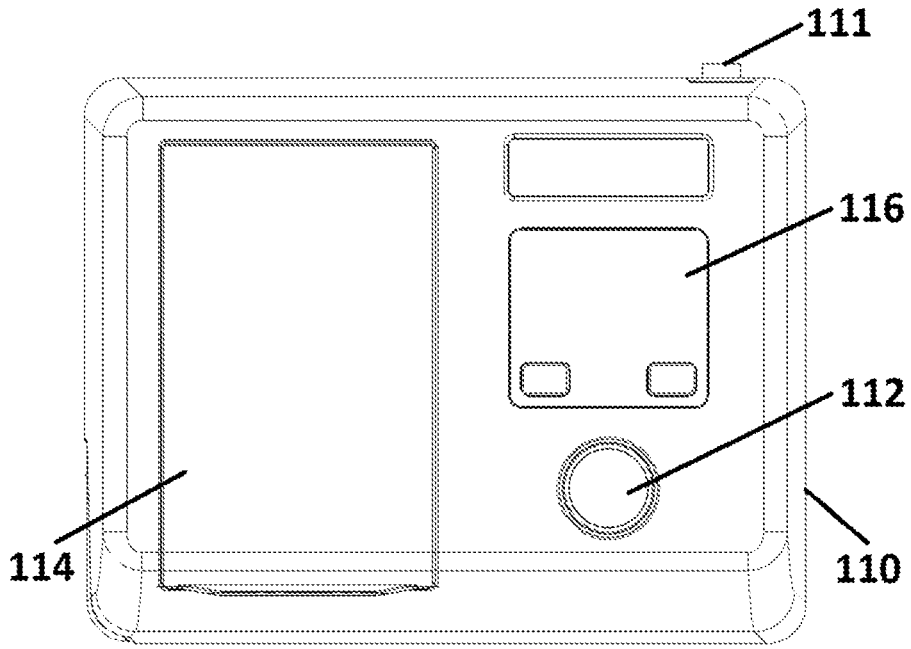
FIG. 1F is a top plan view of the compact cigarette manufacturing machine shown in FIGS. 1A-1E.
Figure 1G:
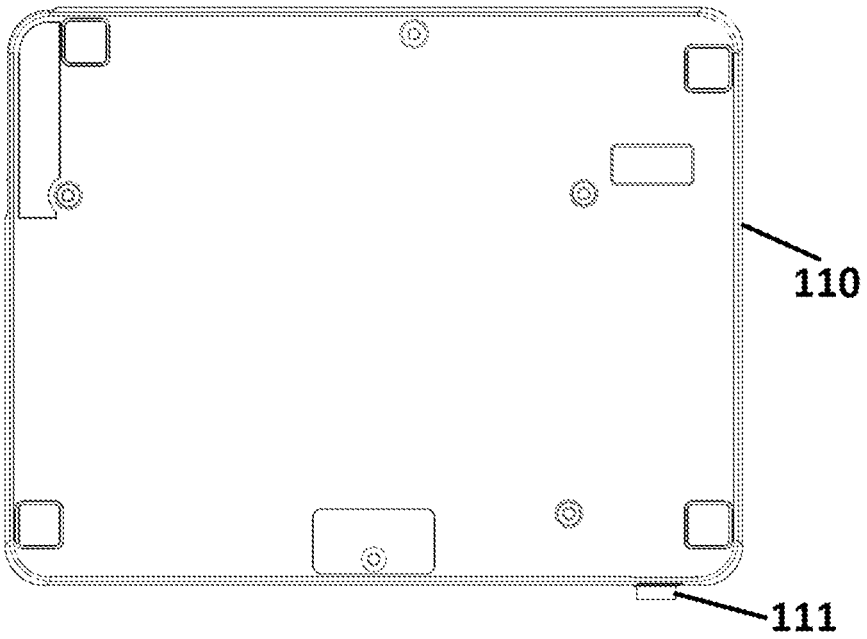
FIG. 1G is a bottom plan view of the compact cigarette manufacturing machine shown in FIGS. 1A-1F.
Figure 1H:
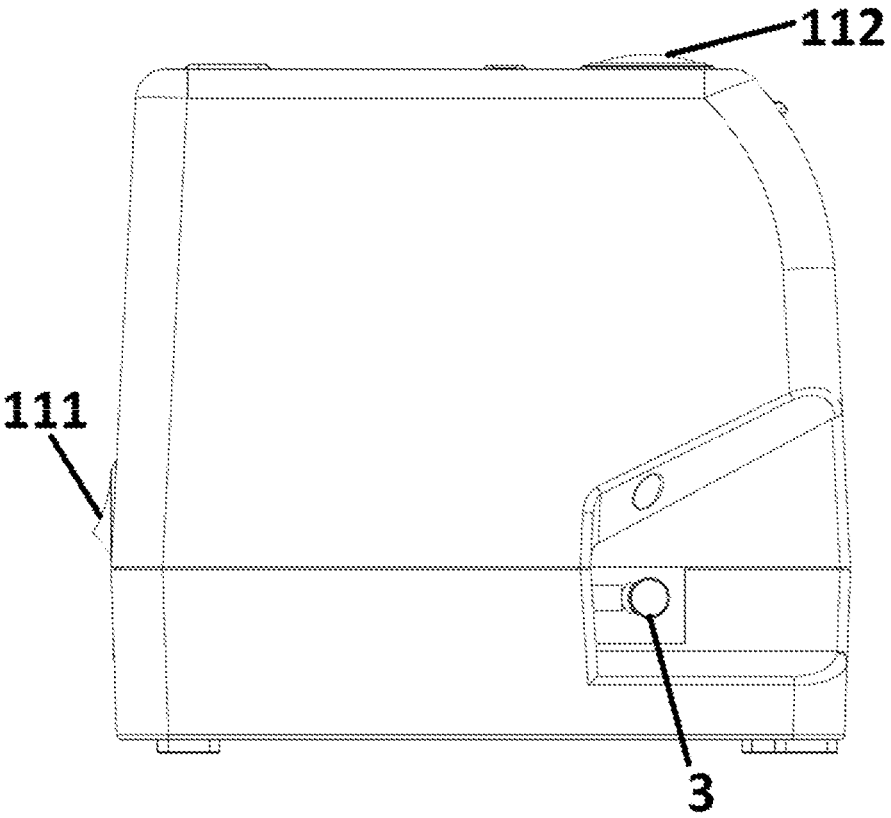
FIG. 1H is a left elevation view of the compact cigarette manufacturing machine shown in FIGS. 1A-1G.
Figure 1I:
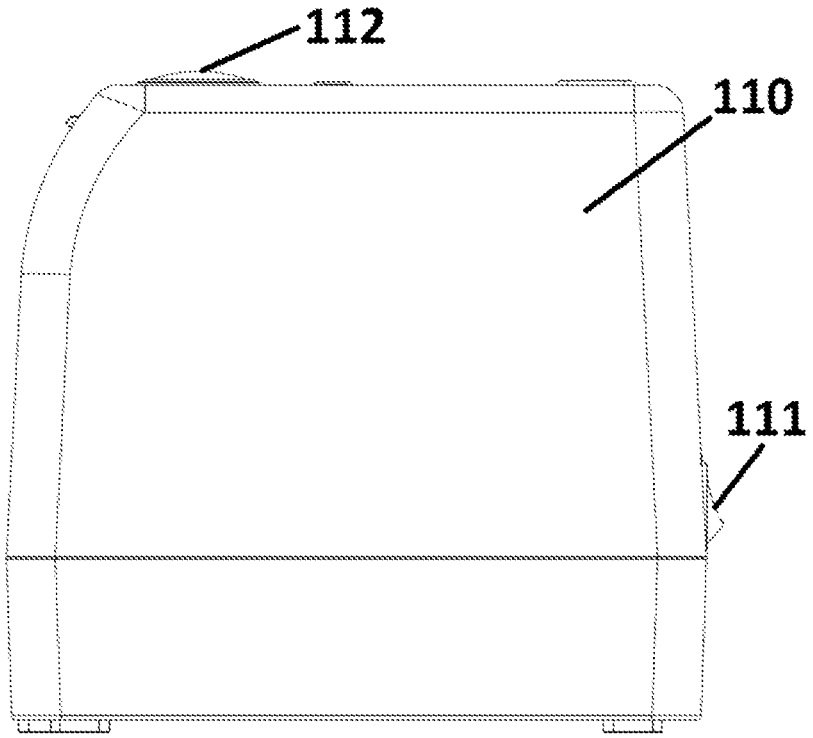
FIG. 1I is a right elevation view of the compact cigarette manufacturing machine shown in FIGS. 1A-1H.
Figure 1J:
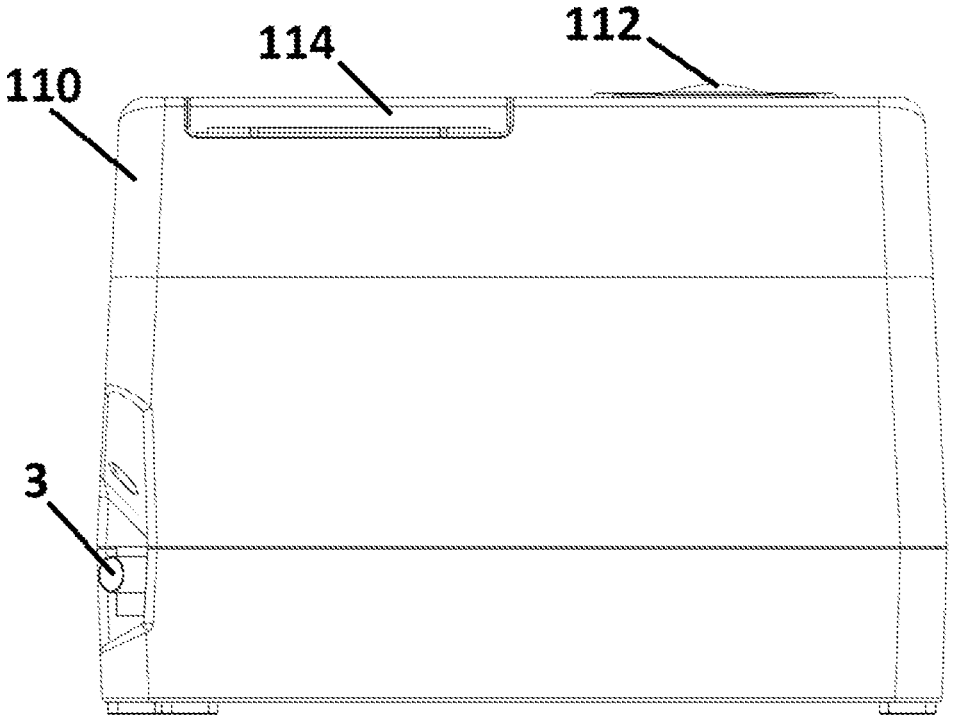
FIG. 1J is a front elevation view of the compact cigarette manufacturing machine shown in FIGS. 1A-1I.
Figure 1K:
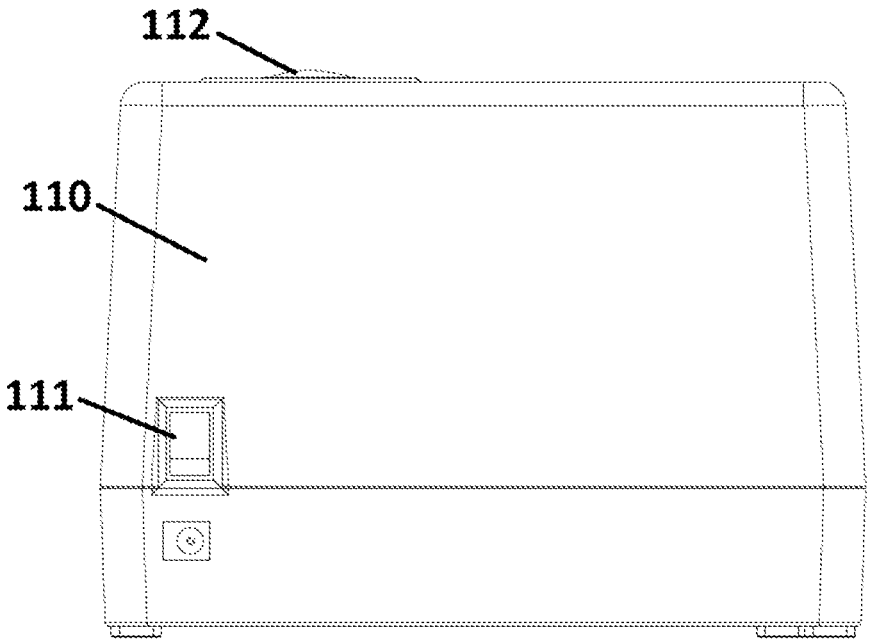
FIG. 1K is a rear elevation view of the compact cigarette manufacturing machine shown in FIGS. 1A-1J.

The invention now will be described more fully hereinafter through reference to various embodiments. These embodiments are provided so that this disclosure convey the scope of the invention to those skilled in the art. Indeed, the invention may be embodied in many different forms and should not be construed as limited to the embodiments set forth herein; rather, these embodiments are provided so that this disclosure will satisfy applicable legal requirements. As used in the specification, and in the appended claims, the singular forms "a", "an", and "the", include plural referents unless the context clearly dictates otherwise.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Parameters identified as "approximate" or "about" a specified value are intended to include both the specified value and values within 10% of the specified value, unless expressly stated otherwise. Further, it is to be understood that the drawings accompanying the present disclosure may, but need not, be to scale, and therefore may be understood as teaching various ratios and proportions evident in the drawings. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. Descriptions of exemplary methods or processes are not limited to inclusion of all steps as being required in all cases, nor is the order that the steps are presented to be construed as required or necessary unless expressly so stated.

Embodiments according to the present disclosure can be used for manufacturing cigarettes from filler material, such as cut tobacco, in small amounts. In addition to cut tobacco, embodiments according to the present disclosure can also be used for filling other materials, such as cut or ground products, into a cigarette tube. Cigarette manufacturing machines according to the present disclosure are compact in size, have simple mechanical structures, and require only simple operations such as depositing cut tobacco or other materials and activating a start switch. In addition, in small-scale operations, the cigarette manufacturing machines fully utilize the deposited materials with little waste, and pack the materials evenly and firmly in the cigarette tube as large-scale machines do.

As illustrated in FIGS. 1A-1K, 2, and 3, in some embodiments, a compact cigarette manufacturing machine 100 comprises a housing 4 enclosing a material chamber 40. The material chamber 40 has a bottom or base surface 42 and an open end 44 for receiving cut tobacco or other materials. The compact cigarette manufacturing machine 100 further comprises a filling pipe 3 coupled with the outer casing 110. The filling pipe 3 extends into a filling cavity 31 below the material chamber 40 and in communication with the material chamber 40 through an opening 43 of the bottom surface 42. The compact cigarette manufacturing machine further comprises a loading element 2 assembled with the housing 4 and slidable along the bottom surface 42. In operation, the loading element 2 loads or pushes the materials received in the material chamber 40 into the filling cavity 31 through the opening 43 of the bottom surface 42. The compact cigarette manufacturing machine 100 further comprises a presser 1 assembled with the housing 4 and operable to press or tamp the materials loaded in the filling cavity 31. The compact cigarette manufacturing machine 100 may further comprise a pusher 7 for compressing and packing the materials in the filling cavity 31. The compact cigarette manufacturing machine 100 further comprises a push spoon 35 slidably disposed inside the filling pipe 3. The push spoon 35 is operable to deliver materials in the filling cavity 31 into a cigarette tube loaded on the filling tip 33 of the filling pipe 3.

Figure 4:
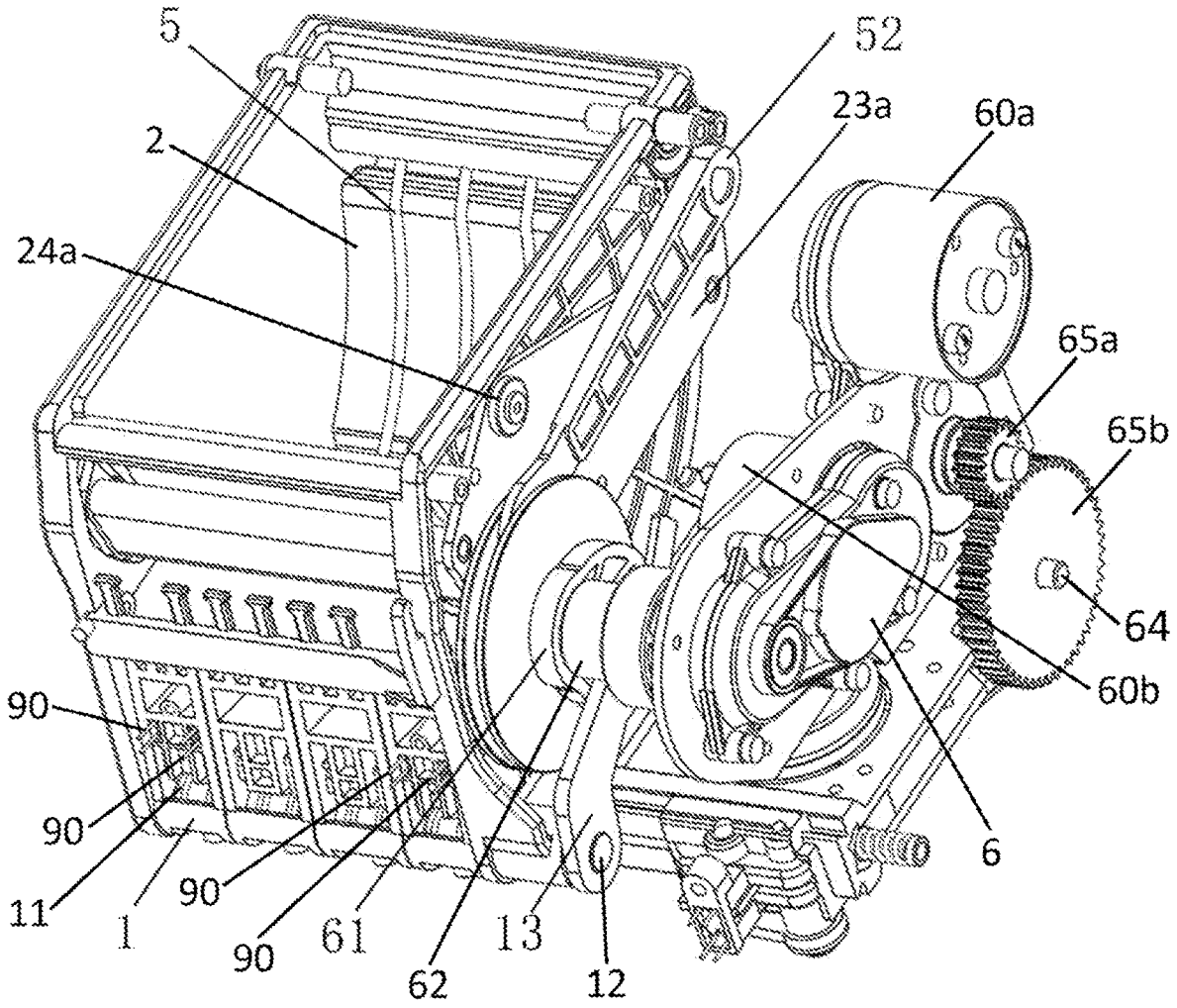
FIG. 4 is a perspective view of the internal structure of a compact cigarette manufacturing machine shown in FIGS. 1A-1K, 2, and 3.
Figure 9:
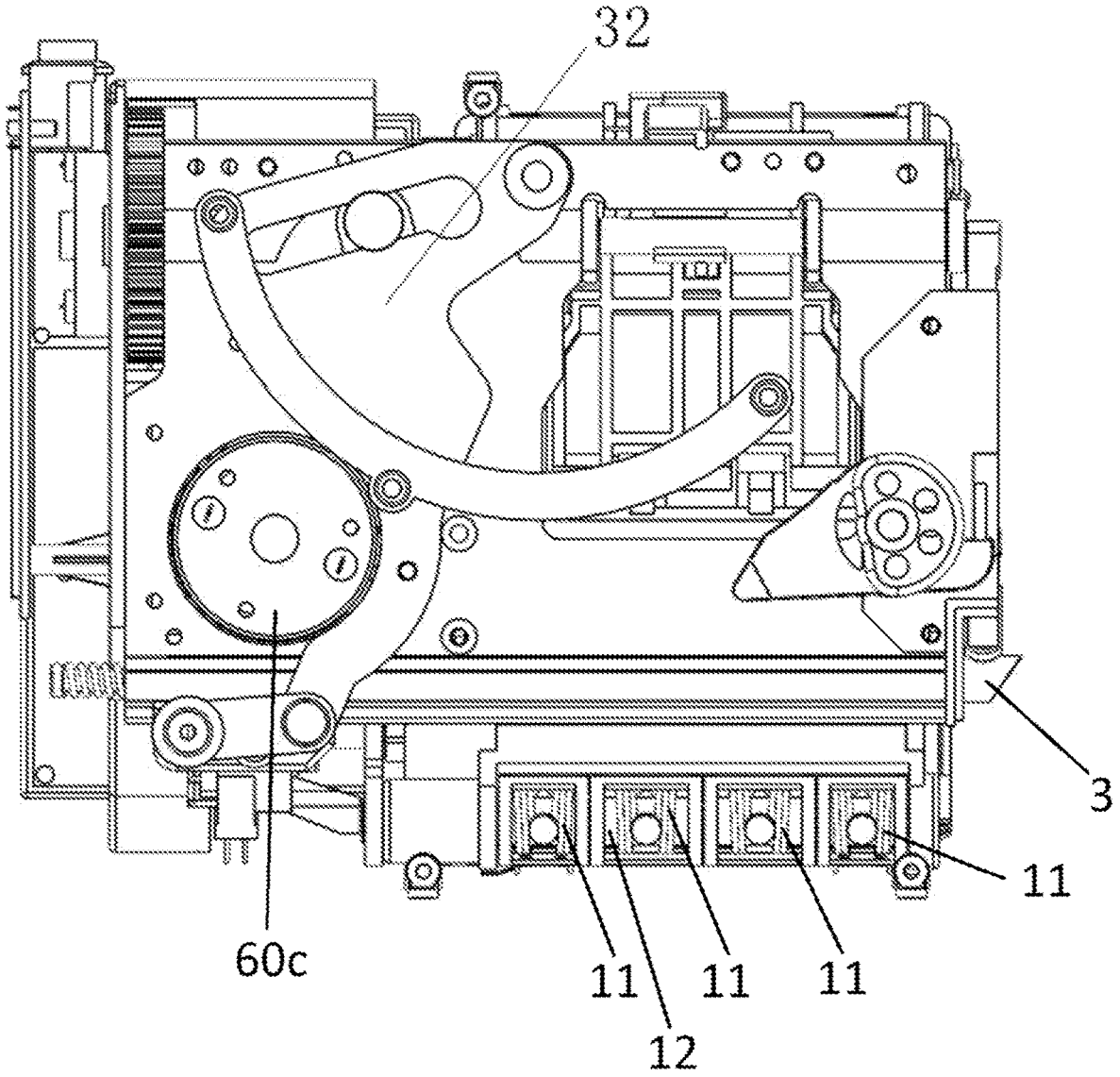
FIG. 9 is a bottom view of the internal structure of a compact cigarette manufacturing machine shown in FIGS. 1A-1K, 2, and 3.

The compact cigarette manufacturing machine 100 further comprises a power source 6 for driving the mechanical components. The power source 6 may comprise one or more electric motors for driving the push spoon 35, the pusher 7, the presser 1, and the loading element 2. As illustrated in FIGS. 4 and 9, the power source 6 may comprise an electric motor 60*a*, an electric motor 60*b*, and an electric motor 60*c*. The power source 6 may comprise an output shaft 62 attached with an eccentric disk 61. The output shaft 62 is driven by an electric motor of the power source 6. For example, as illustrated in FIG. 4, the output shaft 62 is driven by the electric motor 60*b*. The eccentric disk 61 may be directly coupled to the output shaft 62, or be connected to the output shaft 62 through power transmission mechanisms such as timing belts, gears, and reducers.

In some embodiments, the compact cigarette manufacturing machine 100 comprises more than one power source for driving different mechanical components. In some embodiments, one or more mechanical components are manually driven.

As illustrated in FIGS. 1A-1K, in some embodiments, the mechanical components of the compact cigarette manufacturing machine 100 are contained in an outer casing 110. Components for controlling the compact cigarette manufacturing machine 100, such as a power switch 111 and a start switch 112, may be disposed on a surface of the outer casing 110. As illustrated in FIGS. 1A-1K and 2, the outer casing 110 may include a lid 114 facing the open end 44 of the material chamber 40. The lid 114 may be pivotably attached to the casing 110 and can be opened to allow the user to deposit cut tobacco or other materials into the material chamber 40, and can be closed to prevent the deposited materials from spilling out from the material chamber 40 or being contaminated during operation.

Figure 2:
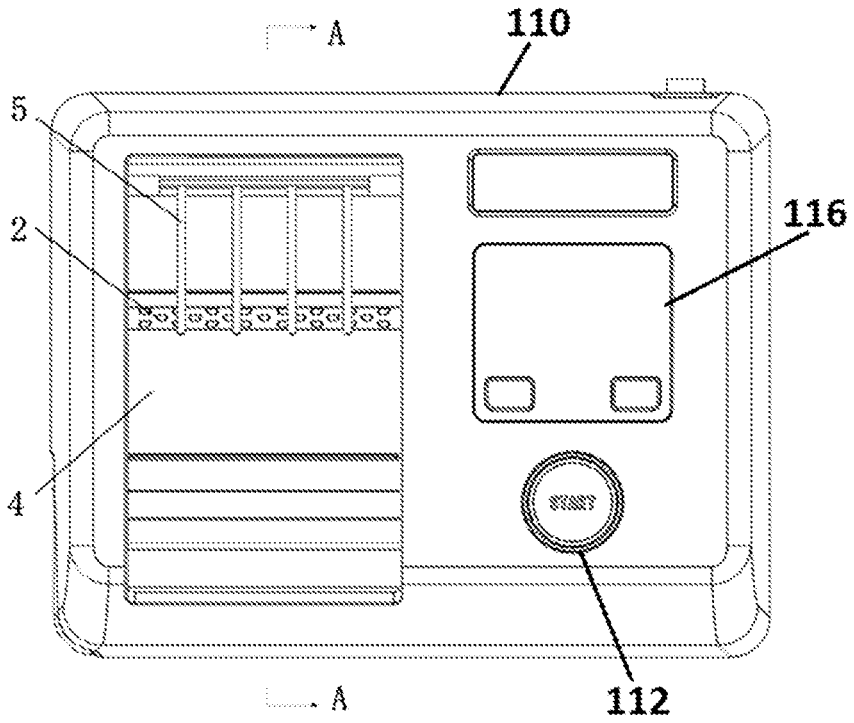
FIG. 2 is a top view of the compact cigarette manufacturing machine shown in FIGS. 1A-1K, where a lid of the compact cigarette manufacturing machine is opened.
Figure 3:
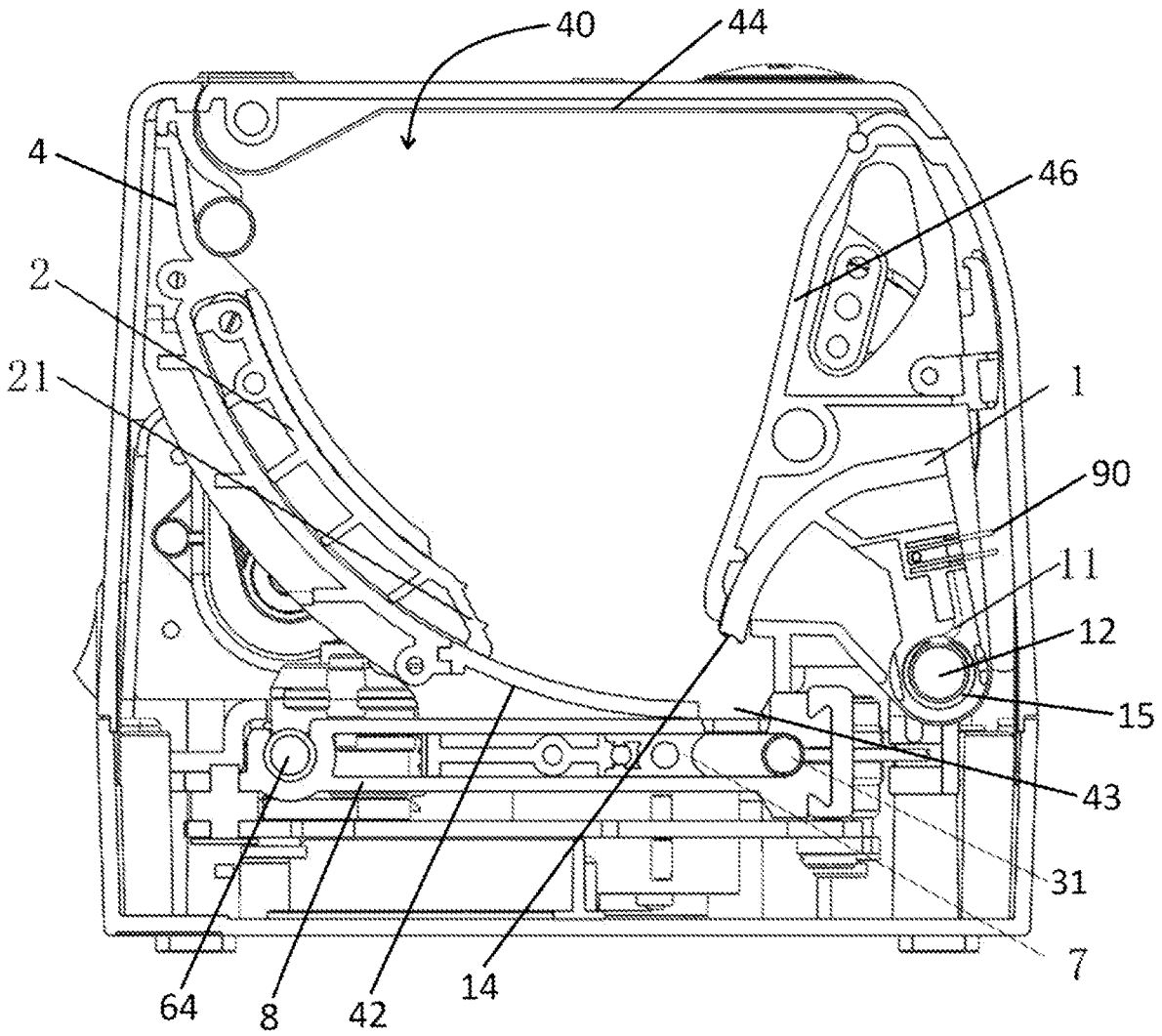
FIG. 3 is a section view of the compact cigarette manufacturing machine across the plane A-A in FIG. 2.

As illustrated in FIGS. 2-4, in some embodiments, the housing 4 comprises the bottom surface 42 and vertical side walls. The bottom surface 42 may have a variety of suitable shapes, and may for example, be ramped or angled to facilitate funneling of the tobacco or other filler material toward the filling cavity 31. For example, the bottom surface 42 may be a curved surface as illustrated in FIG. 3. In various embodiments, the bottom surface 42 may be a horizontal flat surface, or a sloping flat surface. The housing 4 encloses the material chamber 40. As illustrated in FIG. 4, the housing may have an entirely open top portion defining the open end 44 for receiving cut tobacco or other materials. Alternatively, the housing 4 may have one or more openings on the side walls or a top surface, for receiving the materials. As illustrated in FIG. 3, the opening 43 to the filling cavity 31 is formed on the bottom surface 42 of the housing 4, from which materials can fall out of the material chamber 40. In some embodiments, the bottom surface 42 is a curved or sloping surface, and the opening 43 is formed at a lowest portion of the bottom surface 42.

Preferably, the bottom surface 42 of the housing 4 is a curved surface, allowing all of the materials to reach the opening 43, even when a small amount of materials is received in the material chamber 40, and facilitating rotary motion of the loading element 2 along the curved bottom surface 42. The opening 43 and the filling cavity 31 are disposed proximate to each other in order to reduce the horizontal range of movement of the loading element 2. In addition, the loading element 2 may be accommodated in the upper portion of the material chamber 40. As result, the cigarette manufacturing machine 100 has a compact size suitable for domestic use.

As illustrated in FIGS. 3, 5, and 7A-7D, the compact cigarette manufacturing machine 100 may further comprise a bracket 8 disposed beneath the housing 4. The bracket 8 comprises a slot 81. In some embodiments, as illustrated in FIG. 3, the slot 81 and the opening 43 of the bottom surface 42 of the housing 4 have substantially the same width, and the slot 81 is positioned below the opening 43. In other embodiments, the opening 43 is larger in width than the slot 81, such that the top surface of the bracket 8 defines a portion of the material chamber 40.

Figure 7A:
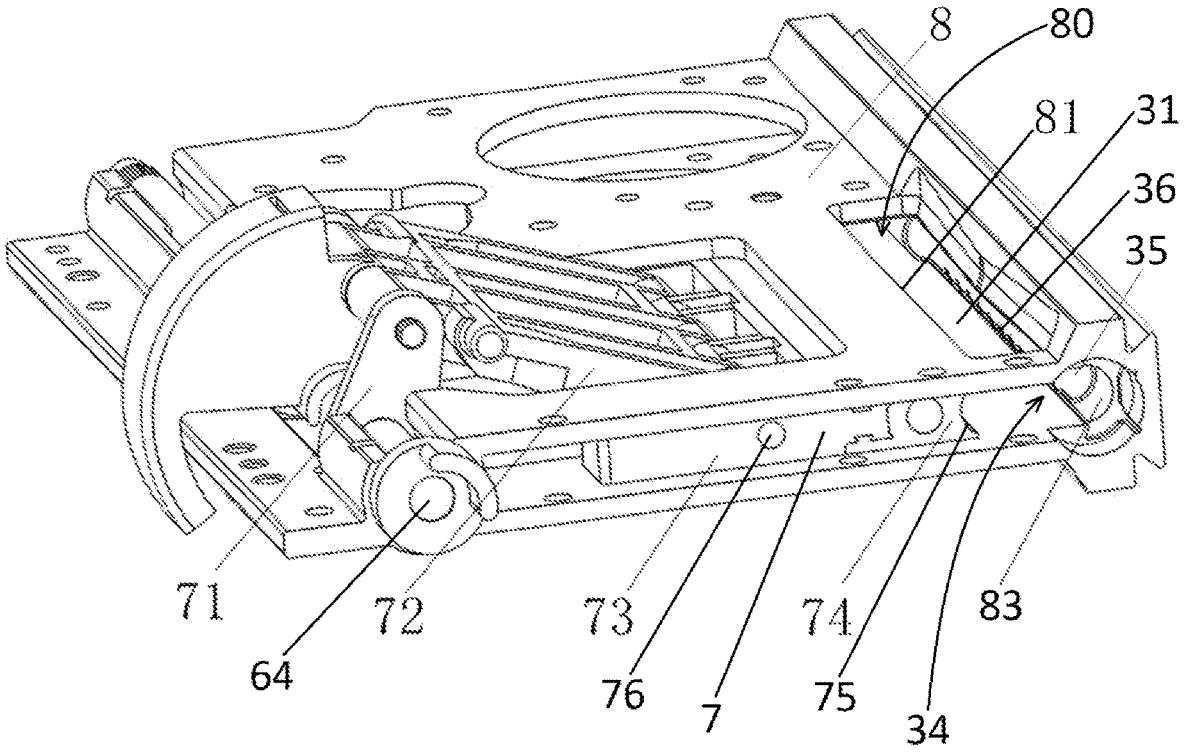
FIG. 7A is a perspective view of the assembly of a bracket, a push spoon, and a pusher according to an exemplary embodiment.
Figure 7B:
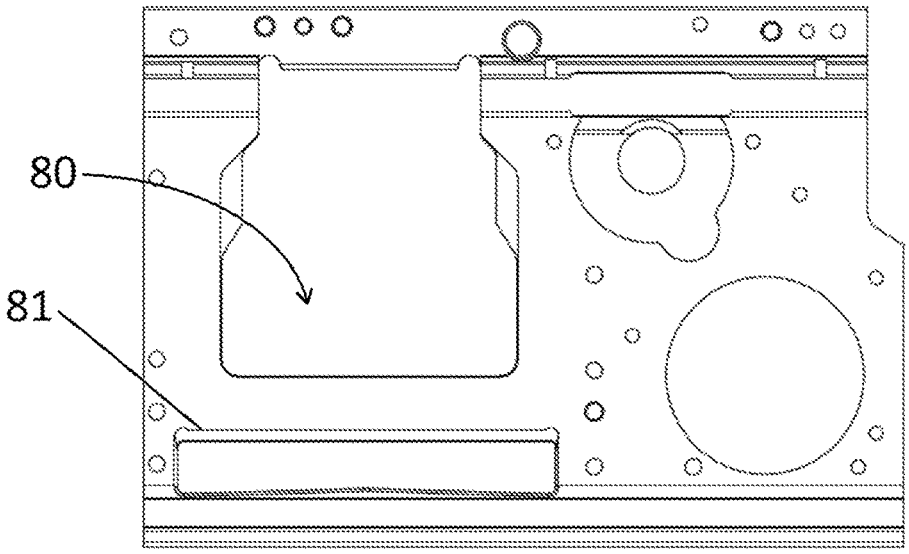
FIG. 7B is a top view of a bracket shown in FIGS. 3-6 and 7A.
Figure 7C:
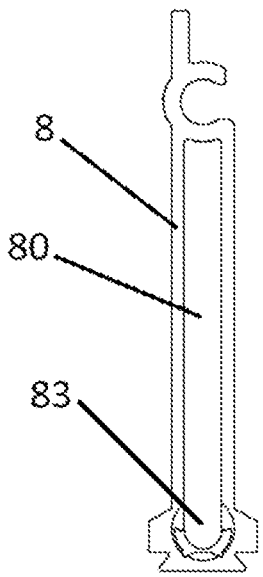
FIG. 7C is a side view of a bracket shown in FIGS. 3-6, 7A, and 7B.
Figure 7D:
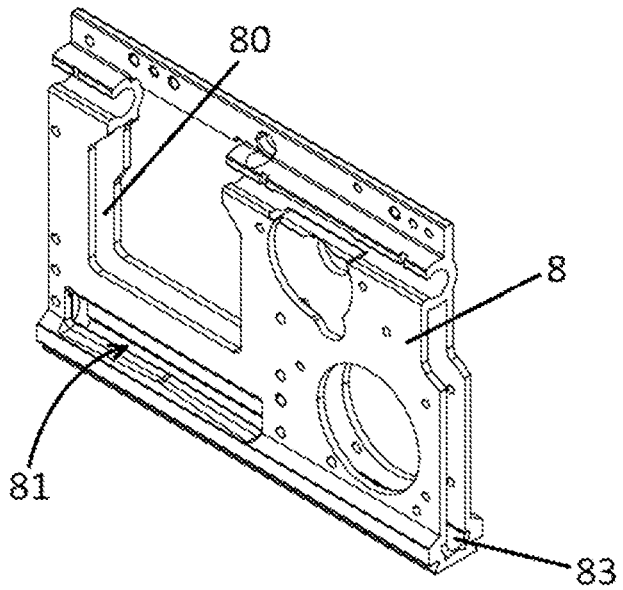
FIG. 7D is a perspective view of a bracket shown in FIGS. 3-6 and 7A-7C.

As illustrated in FIG. 7A-7D, in some embodiments, the bracket 8 defines a cavity 80 accommodating the pusher 7. In some embodiments, the filling cavity 31 is defined within the cavity 80. In some embodiments, as illustrated in FIGS. 7A, 7C, and 7D, the cavity 80 includes a semi-cylindrical recess 83 that is aligned with the filling pipe 3 and defines at least a portion of the filling cavity 31.

Figure 5:
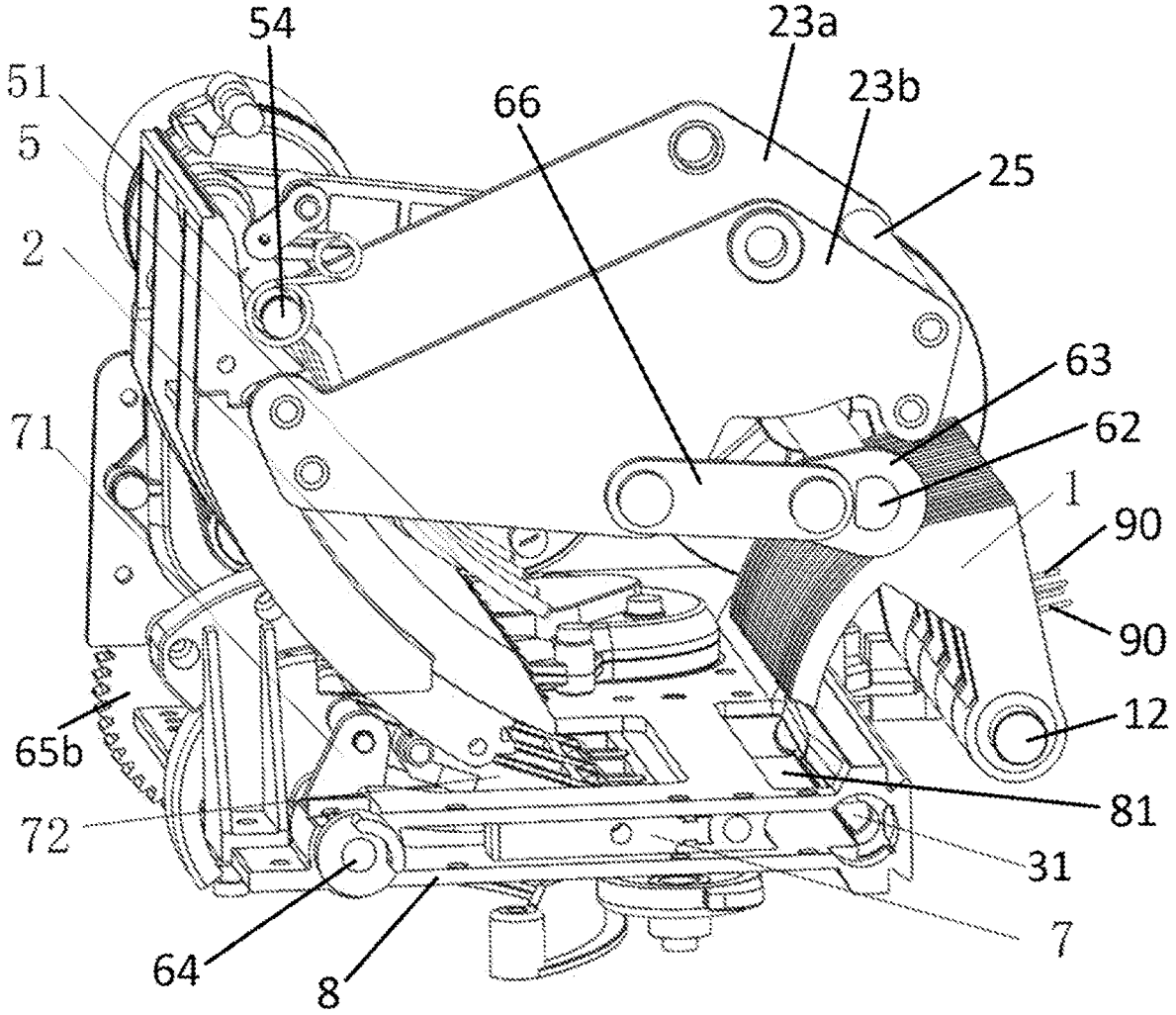
FIG. 5 is a perspective view of the internal structure of a compact cigarette manufacturing machine shown in FIGS. 1A-1K, 2, and 3.

As illustrated in FIGS. 3 and 5, the filling cavity 31 is disposed beneath the material chamber 40. In some embodiments, the filling pipe 3 extends into the filling cavity 31. As illustrated in FIGS. 1A-1K, the filling pipe 3 extends out of the outer casing 110, such that a cigarette tube to be filled can be loaded on the filling tip 33 of the filling pipe 3.

The push spoon 35 is operable to deliver tobacco or other materials in the filling cavity 31 into a cigarette tube loaded on the filling tip 33 of the filling pipe 3. As illustrated in FIG. 7A, the push spoon 35 is slidably disposed inside the filling cavity 31, and may include a hollow recess for carrying the materials in the filling cavity 31. The push spoon 35 is operable to slide within the filling cavity 31 toward the cigarette tube, carry the materials into the cavity of the cigarette tube, deposit the materials, and slide back into the filling cavity 31. In some embodiments, the push spoon 35 is operable to move in reciprocating motion. The push spoon 35 may be driven manually, or by the power source 6 or another power source. For example, as illustrated in FIG. 9, the push spoon 35 may be mechanically coupled to the electric motor 60*c* of the power source 6 through a swing arm 32. In some embodiments, the filling cavity 31 and the push spoon 35 may be configured according to the tobacco cavity and the push spoon assembly disclosed in U.S. Patent Application No. 2020/0281251, the entire disclosure of which is incorporated herein by reference.

As illustrated in FIGS. 1A-1K, 6, and 9, the filling pipe 3 is a substantially cylindrical tube and is coupled with the outer casing 110. The end portion or filling tip 33 of the filling pipe 3 is configured to be received or inserted into the cigarette tube to be filled. The cigarette tube loaded on the filling tip 33 may be held in place by friction with the filling pipe 3. The cigarette tube may also be held in place manually by the user, or by a clip disposed at the filling tip 33. In some embodiments, the compact cigarette manufacturing machine 100 comprises a buckling assembly for pressing the cigarette tube against the filling pipe 3 while materials are being filled into the cigarette tube, and releasing the cigarette tube after the materials are filled. In some embodiments, the buckling assembly may be configured according to the paper buckling assembly disclosed in the above-incorporated U.S. Patent Application No. 2020/0281251.

In some embodiments, the compact cigarette manufacturing machine 100 further comprises a pusher 7. As illustrated in FIG. 5, the pusher 7 is disposed below the material chamber 40 and is operable to move horizontally toward or away from the push spoon 35 in reciprocating motion, in order to compress the loose cut tobacco or other materials. In some embodiments, the pusher 7 is slidably disposed in the cavity 80 defined by the bracket 8. The exemplary pusher 7 is an elongated plate having a concave tip 75 facing the push spoon 35. As illustrated in FIG. 7A, in some embodiments, the push spoon 35 has a horizontal side opening 34 facing the pusher 7, and the filling cavity 31 extends between the push spoon 35 and the concave tip 75 of the pusher 7. As illustrated in FIGS. 3 and 5, the pusher 7 is operable to reach at least the opening 43 of the bottom surface 42 of the housing 4, in order to compress and pack the materials in the filling cavity 31. In some embodiments, the pusher 7 is operable to reach a maximum range toward the filling pipe 3 where the concave tip 75 defines a cylindrical space with the semi-cylindrical recess 83 of the cavity 80, such that the push spoon 35 can pack the cylindrical mass of materials into the filling pipe 3.

In some embodiments, as illustrated in FIG. 7A, a blade 36 for cutting tobacco or other materials is formed on the lower edge of the push spoon 35 facing the filling cavity 31. The blade 36 may be formed on the upper edge and/or the lower edge of the push spoon 35 facing the filling cavity 31. In some embodiments, the blade 36 is disposed on the top edge of the concave tip 75 of the pusher 7. The blade 36 may also be disposed on the bottom edge of the concave tip 75 of the pusher 7. In some embodiments, the blade 36 is oriented in the horizontal direction and facing the filling cavity 31. In some embodiments, the blade 36 is disposed on an edge of the slot 81 of the bracket 8, and is oriented in the horizontal direction and facing the pusher 7. When the pusher 7 moves toward the push spoon 35, the blade 36 cuts across the loose materials hanging over the edge of the filling cavity 31. As result, the mass of cut tobacco or other materials after compression has a smooth surface, without excess materials on the surface which may interfere with the steps that follow, such as filling the materials into the cigarette tube.

The movement of the pusher 7 is driven by the power source 6 through a power transmission mechanism. In some embodiments, as illustrated in FIG. 7A, the power transmission mechanism for the pusher 7 comprises a shaft 64, a cam 71 coupled to the shaft 64, and a transmission plate 72. The shaft 64 is mechanically coupled to and driven by an electric motor of the power source 6. For example, as illustrated in FIGS. 4 and 5, the shaft 64 is driven by the electric motor 60*a* through gearwheels 65*a* and 65*b*.

The transmission plate 72 is coupled with the pusher 7 through a pin 76. The rotation of the shaft 64 drives the horizontal movement of the transmission plate 72 through the cam 71, causing the horizontal movement of the pusher 7.

The pusher 7 may be an integrally formed component, or comprise two or more connected components. In some embodiments, as illustrated in FIG. 7A, the pusher 7 comprises a first connector 73 for coupling with the transmission plate 72 and a second connector 74 partially defining the filling cavity 31. The first connector 73 and the second connector 74 may be affixed to each other, or coupled to each other through mechanical transmission, such that the horizontal movement of the first connector 73 drives the horizontal movement of the second connector 74.

The filling cavity 31 has an open top end aligned with the opening 43 on the bottom surface 42 of the housing 4, such that all materials falling through the opening 43 falls into the filling cavity 31.

As illustrated in FIG. 3, the loading element 2 is assembled with the housing 4 and is operable to slide along the bottom surface 42. In some embodiments, the loading element 2 is operable to move in reciprocating rotary motion. The loading element 2 may have various suitable shapes that fit with the bottom surface 42, in order to prevent cut tobacco or other materials from entering the space in between. For example, as illustrated in FIG. 3, the bottom surface 42 may be a curved surface, and the loading element 2 may have a curved shape that fits with the bottom surface 42. In some embodiments, the bottom surface 42 is formed with slide rails, and the loading element 2 is slidably assembled on the slide rails. In other embodiments, the loading element 2 is slidably coupled with a slit formed on the bottom surface 42 or a side wall of the housing.

In some embodiments, as illustrated in FIG. 3, the front edge of the loading element 2 comprises a narrow, tapered surface 21. The narrow, tapered surface 21 allows the loading element 2 to smoothly pass through the materials on the bottom surface of the housing 4 with limited resistance, with the narrow front end depositing a limited amount of materials into the filling cavity 31. In addition, the tapered surface 21 allows the materials to spread over, and form a thin layer, on the top surface of the loading element 2. As result, only a small amount of materials falls into the filling cavity 31 each time the loading element 2 slides down. As such, the presser 1 only presses a small amount of materials loaded in the filling cavity 31 each time the presser 1 swings down, as small portions of materials enter the filling cavity 31 successively. This prevents the materials from excessively accumulating at one portion of the filling cavity 31 while not adequately filling other portions, which ensures that the materials are packed firmly and evenly in the filling cavity 31.

Figure 6:
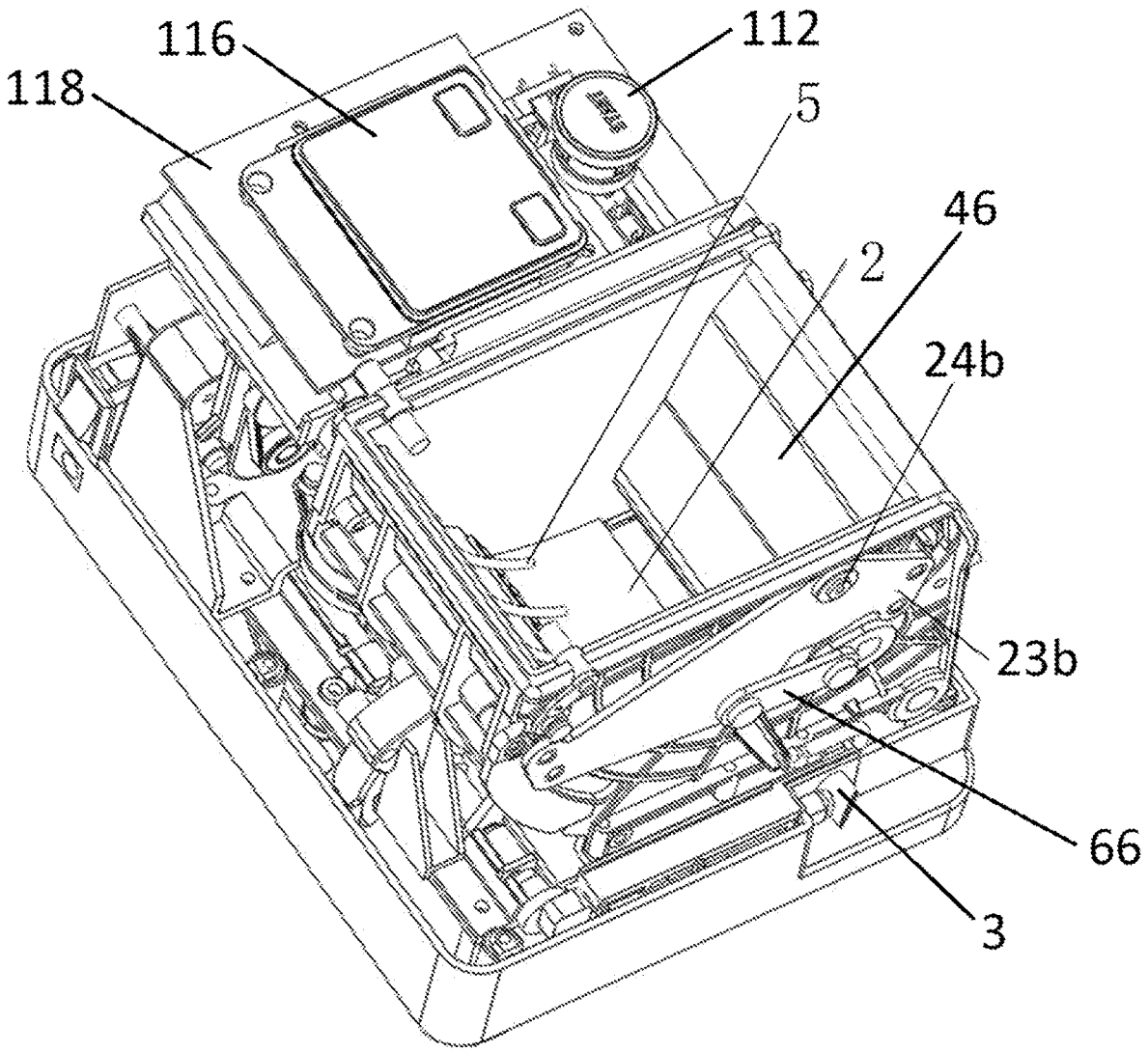
FIG. 6 is a perspective view of the internal structure of a compact cigarette manufacturing machine shown in FIGS. 1A-1K, 2, and 3.

In some embodiments, the loading element 2 is coupled to a pivot affixed to the housing 4 through a swing arm. In other embodiments, as illustrated in FIGS. 4-6, the loading element 2 is coupled to a pair of pivots 24*a* and 24*b* affixed to the two opposing walls of the housing 4, respectively through a pair of swing arms 23*a* and 23*b*. As illustrated in FIGS. 4-6, the pair of pivots and the pair of swing arms are disposed outside the housing 4, and the loading element 2 is coupled to the pair of swing arms through a slit formed along the bottom surface 42 of the housing 4. In various embodiments, each of the pivots and each of the swing arms may be disposed within or outside the housing 4.

As illustrated in FIGS. 4-6, the loading element 2 may be operable to swing about the pivots 24*a* and 24*b* through the swing arms 23*a* and 23*b*. As illustrated in FIG. 4, the swing arms 23*a* and 23*b* may be assembled to the housing 4 through the pivots 24*a* and 24*b*. One end of the swing arms 23*a* and 23*b* is coupled to the loading element 2 and is operable to swing about the pivots 24*a* and 24*b*. At the other end, as illustrated in FIG. 5, the swing arms 23*a* and 23*b* are affixed to each other through a rod 25. In some embodiments, the swing arms are directly connected to the power source 6, in order to drive the movement of the loading element 2. As illustrated in FIG. 5, the swing arm 23*b* may be connected to an eccentric disk 63 provided on the output shaft 62 of the power source 6 through a lever 66. As such, the upward and downward sliding movements of the loading element 2 along the bottom surface 42 of the housing 4 are driven through the swing arm 23*b* and the lever 66. In some embodiments, the swing arms 23*a*, 23*b* each has a bent portion for limiting the movement range of the loading element 2.

In some embodiments, the swing arms are indirectly driven by the power source 6 through other mechanical components.

In some embodiments, the loading element 2 is coupled to a shaft extending across the housing 4, through a swing arm or a pair of swing arms.

In some embodiments, the loading element 2 is directly driven by the power source 6 through power transmission mechanisms. For example, the bottom surface 42 of the housing 4 may comprise a slit, and the power transmission mechanisms may be coupled with the loading element 2 through the slit. In some embodiments, the loading element 2 comprises engagement slots (not shown) at the bottom surface, and the engagement slots engages with an engagement disk (not shown) rotatably assembled to the bottom surface 42 of the housing 4. The engagement disk may be coupled to the power source 6 and have an eccentric shape, such that the rotation of the engagement disk drives the movement of the loading element 2. The loading element 2 may comprise two or more sets of engagement slots for engaging with two or more engagement disks disposed along a horizontal line and having different eccentricities. As such, the loading element 2 is operable in one direction in multiple steps. For example, the loading element 2 may be operable to move back and forth along the bottom surface 42 of the housing 4 in one step or multiple steps.

In some embodiments, the loading element 2 is driven by an engagement disk through a connecting rod (not shown) and a drive rod (not shown). The engagement disk is directly driven by the power source 6 and has an eccentric shape. The engagement disk is coupled with the connecting rod and drives the movement of the connecting rod. The connecting rod has a rotating end coupled with the drive rod through an eccentric disk and gearwheels. The drive rod is coupled with the loading element 2 and drives the reciprocating motion of the loading element 2 within a predetermined range. The loading element 2 may also be mechanically coupled with the power source 6 through any suitable arrangement, including, for example, one or more motors and screws.

In some embodiments, the loading element 2 is mounted on a sliding block operable along a guide rail on the bottom surface 42 of the housing 4. In other embodiments, the loading element 2 may be driven by one or more swing arms, which may provide a simpler and more compact mechanical structure, as illustrated in FIGS. 4-6. Such an arrangement may also reduce exposure of the moving components (e.g., power source 6 components) to contamination by tobacco/material entrapment in gaps or spaces in the loading element arrangement.

The presser 1 comprises a press surface 14 for contacting with and pressing the cut tobacco or other materials. The presser 1 may have a variety of suitable shapes. For example, as illustrated in FIG. 5, the presser 1 may be fan-shaped with a cutout, and assembled with the housing 4 through a shaft 12. In the embodiment illustrated in FIG. 5, the presser 1 is operable to swing about the shaft 12 between a withdrawn position and a pressing position. In some embodiments, the presser 1 is operable to move in reciprocating motion. When the presser 1 moves from the withdrawn position toward the pressing position, the press surface 14 moves squarely toward the filling cavity 31, in order to firmly pack materials into the filling cavity 31. At the withdrawn position, as illustrated in FIG. 5, the press surface 14 is above the bottom of the material chamber 40, allowing materials to enter the filling cavity 31 from the material chamber 40.

As illustrated in FIGS. 3 and 6, a side panel 46 may be provided in the housing 4 to define a side portion of the material chamber 40. As illustrated in FIG. 3, the presser 1 may be disposed behind the side panel 46, such that the presser 1 is substantially outside the material chamber 40 at the withdrawn position and the pressing position.

As illustrated in FIG. 4, the compact cigarette manufacturing machine 100 may further comprise a swing arm 13 for driving the swinging motion of the presser 1. In some embodiments, one end of the swing arm 13 is eccentrically connected to the output shaft 62 of the power source 6, and the other end is connected to the presser 1. For example, as illustrated in FIGS. 4 and 5, the swing arm 13 may have one end connected to the eccentric disk 61 provided on the output shaft 62, and the other end connected to the presser 1 through the shaft 12 provided in the shaft hole 15. In some embodiments, the swing arm 13 is connected to the power source 6 at an upper portion and connected to the presser 1 at a lower portion. In other embodiments, the swing arm 13 is connected to the power source 6 at a lower portion and connected to the presser 1 at an upper portion. The power source 6 causes the relative movement of the two ends of the swing arm 13, driving the presser 1 to swing back and forth in an arc trajectory. In some embodiments, the swing arm 13 has a bent portion for limiting the movement range of the presser 1.

As illustrated in FIGS. 3, 4, and 9, in some embodiments, a torsion spring 11 is provided at the shaft 12. The torsion spring 11 provides a recovery force for the presser 1 to return from the pressing position to the withdrawn position, such that quick reciprocating motion of pressing the cut tobacco or other materials can be achieved. In some embodiments, the recovery force is provided by the torsion spring 11, so that the movement of the presser 1 from the pressing position to the withdrawn position is not driven by the power source 6.

In some embodiments, the presser 1 and the loading element 2 are connected through a connection arm in order to operate cooperatively. With the connection arm, the vertical reciprocating motion of the presser 1 and the horizontal reciprocating motion of the loading element 2 can be driven by a single power source. For example, the presser 1 may start moving from the withdrawn position toward the pressing position to firmly pack materials into the filling cavity 31, when the front edge of the loading element 2 reaches the opening 43 of the bottom surface 42 of the housing 4.

As illustrated in FIGS. 2 and 4-6, the compact cigarette manufacturing machine 100 may further comprise one or more stir bars 5 assembled within the housing 4. The stir bar 5 is operable to swing or rotate in order to agitate the materials received in the material chamber 40, for example by slapping the inner surface of the loading element 2 or material chamber 40. This movement of the stir bar 5 evens the distribution of materials in the material chamber 40 and prevents materials from remaining (e.g., becoming caked or solidified) on the material chamber 40 and/or loading element 2. As illustrated in FIG. 5, the stir bar 5 may be assembled to a shaft 54. A torsion spring 51 may be attached to the shaft 54 for providing a recovery force when the stir bar 5 swings or rotates, in order to increase the strength and speed of stirring. The stir bar 5 may be driven by the power transmission mechanism for the loading element 2, or by an independent power transmission mechanism. As illustrated in FIG. 4, the stir bar 5 may be driven by a swing arm 52 through the shaft 54, where the swing arm 52 is connected to the eccentric disk 61 provided on the output shaft 62 of the power source 6.

The compact cigarette manufacturing machine 100 may further comprise an electric control system comprising a control panel 116 and a circuit board 118. The circuit board is connected with a microcontroller for controlling the power source 6 of the mechanical components. In some embodiments, the microcontroller is capable of receiving data and controlling electric circuits, such as receiving data about the displacement of the presser 1, the loading element 2, and the push spoon 35, and start or stop the power output from the one or more power source. The microcontroller may be, for example, a main control module of a computing device. The control panel controls the power source 6 through connection with the circuit board.

In some embodiments, the compact cigarette manufacturing machine 100 further comprises sensors 90 and components providing signals for the sensors 90, in order to determine the displacement of the presser 1, the loading element 2, and the push spoon 35. The sensors 90 and the components providing signals may be provided on the presser 1, the loading element 2, and the push spoon 35, or on other components of the compact cigarette manufacturing machine 100. The sensors 90 send the microcontroller data representing the displacement of the components in order to control the operation of the compact cigarette manufacturing machine 100. For example, the microcontroller determines whether the filling cavity 31 is fully packed with cut tobacco or other materials based on the displacement of the presser 1, and controls the presser 1 to continue or stop operating.

Figure 8:
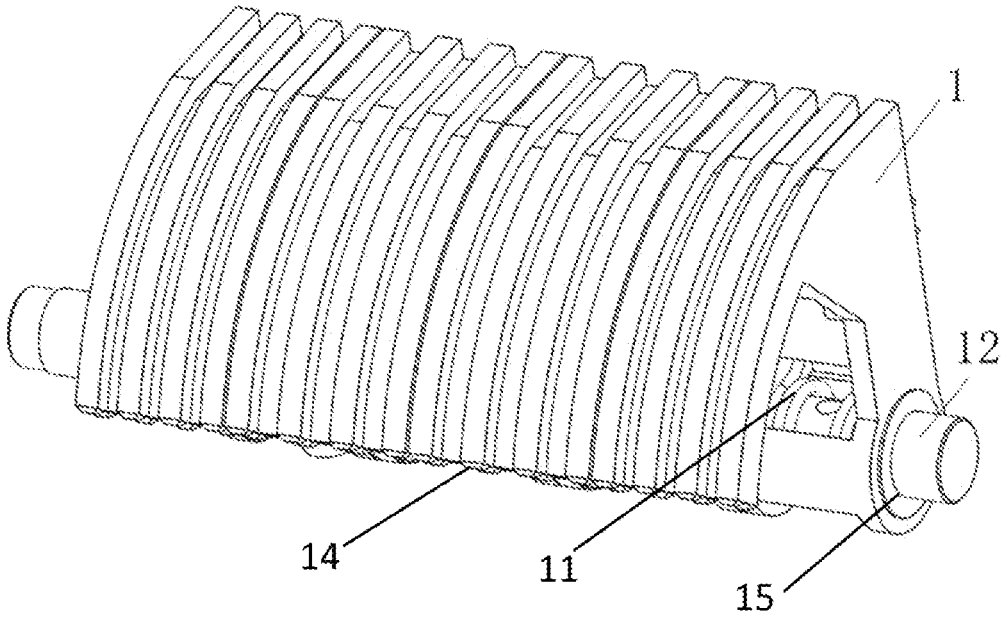
FIG. 8 is a perspective view of a presser according to an exemplary embodiment.

As illustrated in FIGS. 3-5, in some embodiments, the sensors 90 coordinate with the torsion spring 11 provided at the shaft 12 to determine the displacement of the presser 1. The presser 1 may comprise one or more independently movable presser units. In some embodiments, the sensors 90 are provided to determine the displacement of each of the more than one presser units. For example, as illustrated in FIGS. 4 and 8, the presser 1 may comprise four presser units, and each of the pressor units comprises a sensor 90 and a torsion spring 11 for determining the displacement of the corresponding presser unit. As such, when the presser 1 moves toward the pressing position to pack materials into the filling cavity 31, the amount of materials under each of the four presser units can be individually determined by the sensors 90. As compared with the configuration with only one pressor unit, providing two or more pressor units allows the compact cigarette manufacturing machine 100 to continue packing materials into the filling cavity 31 until each portion of the filling cavity 31 is fully packed, when each of the sensors 90 detects at least a predetermined amount of materials under each of the presser units. In addition, the more than one torsion spring 11 may individually adjust the pressing position of each of the pressor units, such that each portion of the filling cavity 31 can be fully packed even if the materials are unevenly distributed in the material chamber 40.

In operation, the lid 114 is opened and the user deposits cut tobacco or other materials to be processed in the housing 4. A cigarette tube is loaded onto the filling tip 33 of the filling pipe 3 coupled with the outer casing 110. The power is switched on (e.g., by depressing the power switch 111 and the start switch 112), and the power source 6 first drives the movement of the presser 1, the loading element 2, and the stir bar 5. The loading element 2 pushes the materials along the bottom surface 42, and the materials falls into the filling cavity 31 through the opening 43 of the bottom surface 42. The presser 1 moves between the withdrawn position and the pressing position to firmly pack the materials into the filling cavity 31. In some embodiments, the presser 1 comprises multiple presser units having multiple sensors 90 for determining the amount of materials under each of the presser units. The sensors 90 transmit data representing the amount of materials under each of the presser units to the microcontroller. When one or more of the sensors 90 indicates that the amount of tobacco/material in the filling cavity 31 is insufficient (e.g., based on the degree of rotation of one or more presser unit), the loading element 2 and the presser 1 repeat their reciprocating movement (as controlled by the microcontroller) to load and press additional tobacco/material into the filling cavity. When the amount of materials under each of the presser units reaches a predetermined amount, the microcontroller stops the movement of the presser 1, the loading element 2, and the stir bar 5. Next, the microcontroller controls the pusher 7 to move toward the push spoon 35, pressing against the materials packed in the filling cavity 31. When the pusher 7 reaches the maximum range toward the push spoon 35, the materials are formed into a cylindrical mass aligned with the filling pipe 3. Lastly, the microcontroller controls the push spoon 35 to deliver the tobacco or other materials into the cigarette tube. The microcontroller also controls the pusher 7 to move away from the push spoon 35. The above process can be repeated until the power is switched off.

What is claimed is:

1. A compact cigarette manufacturing machine comprising:

a housing enclosing a material chamber, the material chamber comprising a bottom surface and an open end for receiving materials to be filled in a cigarette tube;

a filling pipe disposed on the housing to define a filling tip, wherein the filling pipe extends into a filling cavity, wherein the filling cavity is in communication with the material chamber through an opening of the bottom surface of the material chamber;

a loading element assembled with the housing and slidable along the bottom surface of the material chamber, wherein the loading element is operable to load the materials into the filling cavity through the opening of the bottom surface, wherein the loading element is driven by a power source through a swing arm;

a presser assembled with the housing and operable to press the materials loaded in the filling cavity; and a push spoon slidably disposed inside the filling cavity, wherein the push spoon is operable to deliver the materials in the filling cavity into the cigarette tube when the cigarette tube is loaded on the filling tip.

2. The compact cigarette manufacturing machine according to claim 1, wherein the bottom surface of the material chamber is a curved surface.

3. The compact cigarette manufacturing machine according to claim 1, wherein the compact cigarette manufacturing machine further comprises a pusher facing the push spoon, wherein the push spoon has a horizontal opening facing the pusher, and wherein the pusher is operable to move horizontally toward or away from the push spoon in order to compress the materials in the filling cavity.

4. The compact cigarette manufacturing machine according to claim 3, wherein the pusher has a concave tip facing the push spoon.

5. The compact cigarette manufacturing machine according to claim 3, wherein the compact cigarette manufacturing machine further comprises a power source for driving the operation of the pusher.

6. The compact cigarette manufacturing machine according to claim 1, wherein the compact cigarette manufacturing machine further comprises a power source for driving the operation of at least one of the push spoon, the presser, and the loading element.

7. The compact cigarette manufacturing machine according to claim 1, wherein the presser and the loading element operate cooperatively by connection through a connection arm.

8. The compact cigarette manufacturing machine according to claim 3, further comprising a bracket defining a cavity accommodating the pusher and defining at least a portion of the filling cavity, wherein the bracket comprises a slot for communicating the material chamber and the filling cavity.

9. The compact cigarette manufacturing machine according to claim 1, wherein the presser is operable to swing about a shaft between a withdrawn position and a pressing position, and wherein a press surface of the presser moves squarely toward the filling cavity for firmly packing the materials into the filling cavity when the presser moves from the withdrawn position toward the pressing position.

10. The compact cigarette manufacturing machine according to claim 3, further comprising a blade formed on an edge of the push spoon facing the filling cavity.

11. The compact cigarette manufacturing machine according to claim 8, further comprising a blade disposed on a top edge of the pusher and/or an edge of the slot of the bracket, wherein the blade is oriented horizontally and facing the filling cavity.

12. The compact cigarette manufacturing machine according to claim 1, wherein the presser is disposed substantially outside the material chamber.

13. The compact cigarette manufacturing machine according to claim 1, wherein the presser is driven by a power source through a swing arm eccentrically connected to the power source, and wherein the swing arm is connected to the presser through a shaft.

14. The compact cigarette manufacturing machine according to claim 1, wherein the compact cigarette manufacturing machine further comprises at least one stir bar assembled within the housing, wherein the at least one stir bar is operable to swing or rotate in order to agitate the materials in the material chamber, and wherein the at least one stir bar is driven by a power source through an eccentric disk.

15. The compact cigarette manufacturing machine according to claim 1, wherein a front edge of the loading element comprises a tapered surface.

16. The compact cigarette manufacturing machine according to claim 1, wherein the compact cigarette manufacturing machine further comprises one or more sensors for determining the displacement of at least one of the presser, the loading element, and the push spoon.

17. The compact cigarette manufacturing machine according to claim 16, wherein each of the one or more sensors coordinates with a torsion spring to determine the displacement of the presser.

18. The compact cigarette manufacturing machine according to claim 1, wherein the presser comprises two or more presser units, and wherein each of the two or more presser units comprises a sensor and a torsion spring configured to determine the displacement of each of the two or more presser units.

* * * * *